US005277855A

United States Patent [19]

Blackmon et al.

[11] Patent Number: 5,277,855

[45] Date of Patent: Jan. 11, 1994

[54] PROCESS FOR FORMING A YARN HAVING AT LEAST ONE ELECTRICALLY CONDUCTIVE FILAMENT BY SIMULTANEOUSLY COSPINNING CONDUCTIVE AND NON-CONDUCTIVE FILAMENTS

[76] Inventors: Lawrence E. Blackmon, P.O. Box 1034, Foley, Ala. 36535; John D. Forster, 8010 Tower Ter., Pensacola, Fla. 32505; Walter J. Nunning, 4600 Avenida Marina, Pensacola, Fla. 32504

[21] Appl. No.: 956,214

[22] Filed: Oct. 5, 1992

[51] Int. Cl.[5] ..... D01D 5/34; D01F 1/09; D01F 8/04; D02G 3/12

[52] U.S. Cl. ..... 264/103; 57/244; 57/901; 264/105; 264/171; 264/177.13; 264/211; 264/211.12

[58] Field of Search ..... 264/103, 104, 105, 171, 264/177.13, 211, 211.12; 57/244, 245, 901

[56] References Cited

U.S. PATENT DOCUMENTS

| | | | |
|---|---|---|---|
| 3,771,307 | 11/1973 | Petrille | 57/288 |
| 3,900,676 | 8/1975 | Alderson | 264/210.8 X |
| 3,969,559 | 7/1976 | Boe | 428/87 |
| 3,971,202 | 7/1976 | Windley | 57/205 |
| 4,045,949 | 9/1977 | Paton et al. | 57/244 |
| 4,085,182 | 4/1978 | Kato | 264/171 |
| 4,129,677 | 12/1978 | Boe | 428/372 |
| 4,207,376 | 6/1980 | Nagayasu et al. | 428/367 |
| 4,216,264 | 8/1980 | Naruse et al. | 428/397 |
| 4,309,479 | 1/1982 | Naruse et al. | 428/397 |
| 4,369,622 | 1/1983 | Teed | 57/315 |
| 4,612,150 | 9/1986 | De Howitt | 264/103 |
| 4,617,235 | 10/1986 | Ohe et al. | 428/374 |
| 4,756,969 | 7/1988 | Takeda | 428/372 |
| 4,771,596 | 9/1988 | Klein | 57/2 |
| 4,824,623 | 4/1989 | Rambosek | 264/60 |
| 4,900,495 | 2/1990 | Lin | 264/103 |

*Primary Examiner*—Leo B. Tentoni

[57] ABSTRACT

The present invention is directed to a process for forming a yarn having at least one conductive filament wherein the conductive and nonconductive filaments which make up the yarn are simultaneously co-spun. The present process can be performed at spinning speeds of above about 3500 meters per minute to produce a yarn useful in antistatic carpet production.

11 Claims, 1 Drawing Sheet

PROCESS FOR FORMING A YARN HAVING AT LEAST ONE ELECTRICALLY CONDUCTIVE FILAMENT BY SIMULTANEOUSLY COSPINNING CONDUCTIVE AND NON-CONDUCTIVE FILAMENTS

BACKGROUND OF THE INVENTION

1. Field of the Invention

The present invention is directed to a process for forming a yarn useful in forming antistatic carpet. More specifically, the present invention is directed to a process for forming a yarn which includes a plurality of nonconductive filaments and at least one conductive filament. Most specifically, the present invention is directed to a process for forming a yarn wherein the conductive filament or filaments are simultaneously co-spun with the nonconductive filaments.

2. Description of the Prior Art

It is well known that static electricity may be generated when a person walks across a conventional carpet formed from synthetic fibrous materials such as nylon, acrylics, polyester, and the like. The discharge of the static electricity when a person is grounded subsequent to walking across such a carpet can be annoying if not discomforting.

One solution to this problem has been to incorporate electrically conductive fibers (hereinafter referred to simply as conductive fiber) into yarns which are subsequently incorporated into carpets to dissipate static electric charges. These conductive fibers typically include a non-conductive fiber-forming polymer as their major component and a conductive material, usually a dispersion of a conductive particulate material in a polymeric carrier.

The prior art has provided a number of methods for incorporating such a conductive fiber into a yarn to impart antistatic properties. For example, U.S. Pat. No. 4,612,150, to De Howitt, discloses a process for combining antistatic filaments and nylon filaments wherein separately spun conductive bicomponent filaments are pneumatically introduced into a freshly spun nonconductive threadline within the quench chimney. U.S. Pat. No. 4,900,495 to Lin discloses a similar antistatic yarn production process wherein a previously formed conductive filament is combined with freshly spun, nonconductive filaments.

Although these processes are useful in producing acceptable products, they have a number of serious drawbacks. First, this procedure is quite expensive, as the separate formulation of the conductive fiber and its subsequent addition in the threadline can add a significant amount to the end product cost. Also, as the addition of the previously formed conductive filament is at the periphery of the nonconductive threadline, intermingling of the conductive filament with the nonconductive filaments is limited. This limited intermingling can have a negative effect on the subsequent processing of the resulting yarn and can result in severe color pollution (due to visibility of conductive filament). Further, since the conductive filaments and nonconductive filaments were separately formed and have different thermal histories, their individual properties, such as shrinkage and crystalline structure are different. These differences can cause breakage of one or more of the conductive filaments during processing. More specifically, it is noted in the description of the '150 patent found in the '495 patent that the spinning and winding speed of the nonconductive filaments are established so that the conductive filaments will not break when they are drawn at the same ratio as is required for the nonconductive filaments.

A need, therefore, exists for an improved antistatic yarn production process which overcomes these and other deficiencies which are inherent in the prior art processes.

SUMMARY OF THE INVENTION

The present invention provides a process for forming a yarn having at least one electrically conductive filament wherein the conductive filament(s) of the yarn are simultaneously co-spun with the nonconductive filaments of the yarn. More specifically, the process includes the following steps:

(a) passing a plurality of molten streams downward into a quenching zone, said streams including at least one first stream comprising an electrically conductive material dispersed in a polymeric matrix and at least one second stream consisting essentially of a nonconductive, fiber-forming polymer;

(b) solidifying said molten streams to form a plurality of filaments including at least one conductive filament and at least one nonconductive filament; and (c) converging said nonconductive filament(s) and said conductive filament(s) to form a yarn.

BRIEF DESCRIPTION OF THE DRAWINGS

FIG. 2 (*b*) is a cross-sectional view of a representative first stream of a second preferred embodiment of the present invention with the cross-section taken transversely across the longitudinal axis of the stream;

DETAILED DESCRIPTION OF THE PREFERRED EMBODIMENTS

Figure 1:
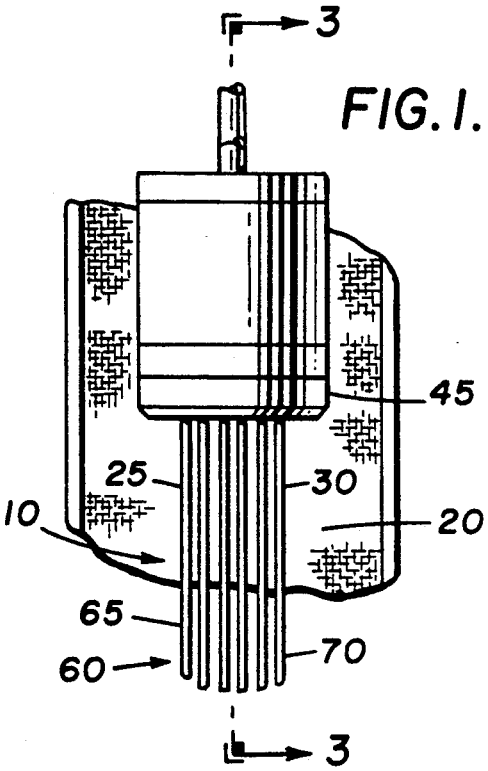
FIG. 1 is a side elevation view of the spinning equipment utilized in performing the process of the present invention.
Figure 2A:
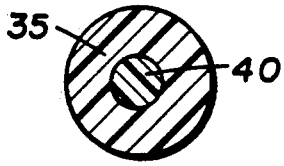
FIG. 2 (*a*) is a cross-sectional view of a representative first stream of a first preferred embodiment of the present invention with cross-section taken transversely across the longitudinal axis of the stream.
Figure 2B:
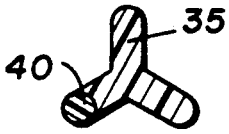

As referenced above and shown in FIG. 1, the first step in the process of the present invention includes passing a plurality of molten streams 10 into a quenching zone 20. The molten streams 10 include at least one first stream, representatively shown as 25, and at least one second stream, representatively shown as 30. First stream 25 includes an electrically conductive material dispersed in a polymeric matrix. As shown in FIGS. 2(*a*) and 2(*b*) first stream 25 preferably includes a first component 35 of a polymeric, fiber forming material coextensive with a second component 40 which includes an electrically conductive material dispersed in a polymeric matrix. First component 35 and second component 40 may be arranged in a "sheath/core" arrangement as shown in FIG. 2 (*a*) and disclosed U.S. Pat. No. 3,803,453 to Hull, the disclosure of which is incorporated herein by reference, or in a "side-by-side" arrangement as shown in FIG. 2 (*b*) and disclosed in U.S. Pat. No. 3,969,559 to Boe, the disclosure of which is incorporated herein by reference. The polymeric matrix of the second component 40 is most preferably formed from nylon-6 but may also be formed from other polymeric materials including nylon 66, polyester, propypropylene and the like, while the conductive material is most preferably particulate carbon black but may be other conductive materials including $TiO_2$ coated with a conductive material. The amount of conductive material in the conductive filament is preferably from 10 to 50% by weight of the second component based on the total weight of the second component. The first component 35 is most preferably nylon 6,6 but may be formed from other materials including nylon 6, polyester, polypropylene, and the like.

Figure 3:
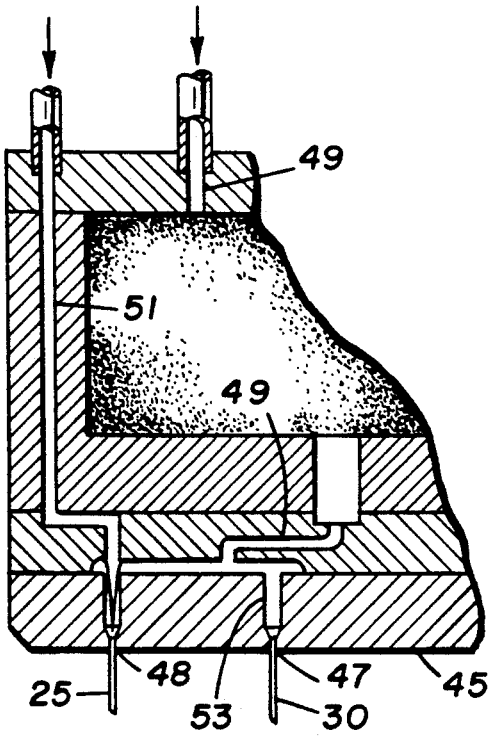
FIG. 3 is a cross-sectional view, taken along line 3—3 of FIG. 1, of a portion of a first preferred embodiment of the spinning equipment of the present invention.
Figure 4:
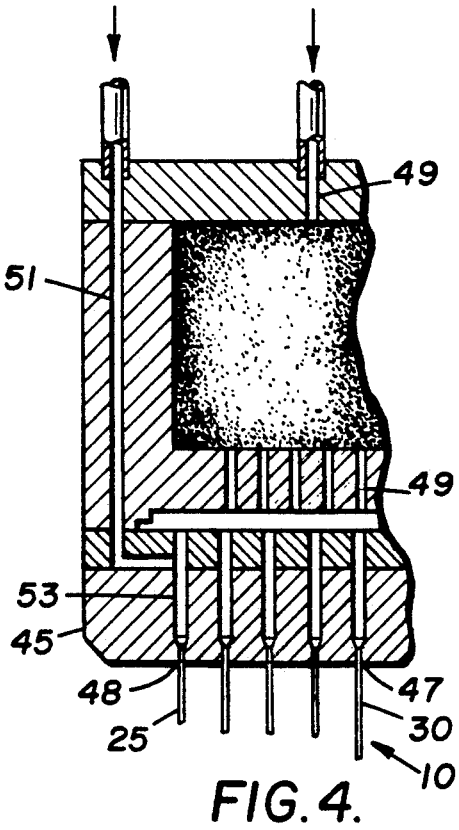
FIG. 4 is a cross-sectional view, taken along line 3—3 of FIG. 1, of a portion of a second preferred embodiment of the spinning equipment of the present invention.

Spinning equipment useful in forming the molten streams 10 is shown in FIGS. 1, 3 and 4. The equipment includes a spinneret 45 having a plurality of capillaries 47 from which molten streams 10 flow to quenching zone 20. At least one first component material passageway 49 is separate from second component material passageways 51 except at least at one counterbore 53 of one cospinning capillary 48 where at least one first stream 25 is formed. Although one such counterbore is shown as being representative, it is to be understood that one such capillary 48 will be used for each first stream desired; preferably, 1 to 5 first streams are to be produced.

At this capillary, a stream of first component passageway 49 merges with a stream of second component in passageway 51 with the first component passageways 49 intersecting with the second component passageway 51.

In a first preferred embodiment, these passageways intersect as shown in FIG. 3 to form a "sheath/core" arrangement between the first component 40 and the second component 35 of the first stream 25. Specifically, the second component material passageway 51 terminates at counterbore 53 at a location along the central longitudinal axis of the capillary 48 while the first component material passageway 49 extends circumferentially around the second component material passageway 51 at counterbore 53. The resulting flow pattern in capillary 48 is a centrally located "core" of second component 40 surrounded by coextensive, circumferential "sheath" of first component 35.

In a second preferred embodiment, the passageways intersect as shown in FIG. 4 to form a "side-by-side" arrangement between the first component 35 and the second component 40 of the first stream. Specifically, the second component material passageway 51 terminates at counterbore 53 immediately adjacent the first component material passageway 49. The resulting flow pattern in cospinning capillary 48 consists of adjacent, coextensive streams of first component 35 and second component 40.

Although "sheath/core" and "side-by-side" arrangements for the first stream 25 are preferred, other arrangements for first stream 25 are within the scope of the present invention.

Molten streams 10 pass through quench zone 20 where streams are quenched to form filaments 60 by conventional means such as a cross-flow of quenching air (not shown). Each first stream 25 will solidify to form first filament 65 while each second stream 30 will solidify to form second filaments 70. As each first stream 25 includes conductive material, each first filament 65 is conductive, while each second filament 70 formed from a nonconductive second stream 30 are correspondingly nonconductive. Filaments 65 are of sheath-core structure when first stream 25 is as shown in FIG. 2(*a*) and are of side-by-side structure when first stream 25 is as shown in FIG. 2(*b*). Filaments 60 may be of any cross-sectional shape, including round, trilobal, pentalobal and the like; however, round is preferred. The shape of spinneret capillaries 47 and 48 should be selected to provide the desired filament cross-sections, and may be the same or different within each spinneret. For example, capillaries 47 may be trilobal while cospinning capillaries 48 may be round.

Preferably, filaments 60 are withdrawn by conventional means such as a godet after solidifying preferably so that first filaments 65 and second filaments 70 are withdrawn at the same take-up velocity or spinning speed which is defined as the speed of the first godet. This spinning speed may be above 6000 mpm with the actual speed depending on the specific yarn being produced (i.e. feedstock for subsequent drawing, spin oriented carpet yarn, etc.). While the process of the present invention is useful in processes having a variety of spinning speeds, its advantages are most pronounced in processes having spinning speeds of above 1500 meters per minute, particularly above 2500 mpm. Most preferably, both first and second filaments, after withdrawing, have a denier of about 6 to about 60.

Subsequent to filament formation, the filaments are converged to form a yarn by conventional means, such as a ceramic convergence guide, with the yarn comprising at least 40 filaments about 1 to about 5 of which are first filaments. The denier of the yarn is preferably between 300 and 4000.

The following example, while given to illustrate the process of the present invention, is not intended to limit its scope. All percentages are by weight unless otherwise indicated.

EXAMPLE 1

Conductive polymer chips were produced by combining 33% carbon black and 67% molten nylon-6 in a conventional compounding machine and extruding, quenching and cutting the mixture by conventional means. Nonconductive nylon-6,6 chips were separately but similarly produced by extruding, quenching and cutting the material by conventional means.

A single screw plasticating extruder was used to melt the conductive polymer chips and pump the molten conductive polymers to a standard polymer gear pump which delivered the polymer to a spinneret used to extrude 60 trilobal carpet yarn filaments. The nonconductive nylon 6,6 pellets were melted in another extruder and the molten nonconductive polymer was delivered to a gear-type pump which delivered the nonconductive polymer to the spinneret.

Passageways were provided in the spinning equipment to keep the conductive polymer separate from the nonconductive polymer except for the counterbore at one of the 60 spinneret capillaries. At this counterbore, where a stream of conductive polymer merged with a stream of nonconductive polymer, the conductive polymer passageway intersected with the nonconductive polymer passageways in a position where, due to two-phase laminar fluid flow in the counterbore and capillary, the conductive polymer was extruded as a continuous strip at the tip of one lobe of a trilobal fiber.

A yarn was formed from these filaments in accordance with the process disclosed in U.S. Pat. No. 4,975,325 to McKinney et al, which is incorporated herein by reference, except that the yarn was passed through a jet-texturing device prior to winding. Yarn take-up velocity was 4000 meters per minute (mpm) and denier was about 1250.

The resulting yarn consisted of 59 filaments of 100% nonconductive nylon 6,6 and one conductive bicomponent filament including about 5% conductive polymer and about 95% nonconductive nylon-6,6. The conductive polymer was a dispersion of 33% carbon black in 67% nylon-6.

Visual examination of Example 1 yarn showed that the conductive filament was entangled with the remaining filaments in the yarn to the same extent as any of the other filaments was entangled with the remaining filaments. This is a significant improvement over what is observed when solidified conductive yarn (one or more filaments) are withdrawn from yarn packages and separately inserted into the non-conductive filament spinline as in the prior art. In this prior art process, the conductive filaments are (1) generally observed to be entangled with the non-conductive filaments of the yarn to a lesser degree than non-conductive filaments are entangled with each other and (2) generally appear shorter than the non-conductive filaments. This apparent length difference is attributed to differences in the contraction (or growth) of the fibers after the yarn has passed the first spinning godet.

One end of each yarn of Example 1 was cabled with the other end of the same yarn using a Volkman cabler to produce a cabled yarn having about 3.7 ply-twist turns per inch. The gathering of wads of non-conductive filaments at guides, which is observed when cabling yarns having conductive filaments that were inserted via the prior art process in the spinline at high speed was not observed when cabling the yarn of Example 1.

Carpet samples were then produced using typical carpet construction techniques for making a Saxony cut-pile carpet. The following conditions were used:

| | |
|---|---|
| Pile Face Weight | 26 oz./sq. yd. |
| Pile Height | 5/8 in. |
| Tuft Gauge | 5/32 in. |

EXAMPLE 2

A control yarn was prepared for comparison with the yarn formed in Example 1. Specifically, nylon 6,6 pellets were produced by conventional extruding, quenching and cutting means and the pellets were melted in a single screw plasticating extruder. The melt was delivered by a gear-type pump to a conventional 60-capillary spinneret where the polymer was extruded into filaments. These filaments were formed into yarn and the yarn was cabled by the processes set forth in Example 1. Carpet samples having the same parameters as the Example 1 samples were then produced using conventional techniques for making a saxony cut-pile carpet.

Testing of Anti-Static Properties

Samples of the carpets from Examples 1 and 2 were then tested for resistance to build-up of static electrical charge according to AATCC Test Method 134-1979. This test procedure yields an electrical voltage which is an indicator of static propensity of the carpet under the conditions of the test. This test yields high voltages for carpets having poor resistance to static charge build-up and yields low voltages for carpets having good resistance to static charge build-up. Carpets that exhibit readings of less than 4 kilo-volts i test are considered to have acceptable resistance to static electric charge build-up.

Data in Table 1 below indicate that the control carpet of Example 2 exhibited unacceptable resistance to static charge build-up (>4 kilo-volts); however carpet made from the yarn produced by the process of the present invention (Example 1) exhibited acceptable resistance (<4 kilo-volts). This demonstrates that while the invention improves the processing of yarn containing conductive filament(s), the invention also provides for acceptable resistance to static electric charge for carpets produced from the yarn.

TABLE 1

| | RESISTANCE TO BUILD-UP OF STATIC ELECTRIC CHARGE (KILO-VOLTS) | | | | |
|---|---|---|---|---|---|
| EXAMPLE | CONDUCTIVE FILAMENT | DAY 1 | DAY 2 | DAY 3 | AVERAGE |
| 1 | Yes (co-spinning) | 0.8 | 1.0 | 1.0 | 0.9 |
| 2 | none | 9.0 | 7.5 | 8.0 | 8.2 |

Although the process of the present invention has been described with detail in this specification, it is to be understood that various modifications and changes may be made to the present process without departing from the spirit and scope thereof. More specifically, the co-spinning process of the present invention is operative within various types of spinning process performed at various spinning speeds. For example, the present co-spinning process may be (a) a part of a conventional process for producing as-spun filament yarns. Typically, such a process operates at spinning speeds of about 300–700 meters per minute (mpm); (b) as part of a so-called "spin-draw" BCF production process which can operate at spinning speeds of above about 1500 mpm, wherein the spinning speed is defined as above the spinning speed of the first godet, and which is generally illustrated in U.S. Pat. No. 4,612,150; or (c) as part of a process such as that described in U.S. Pat. No. 4,975,325 to McKinney et al which operates at spinning speeds above about 3500 meters per minute, wherein the spinning speed is defined as the speed of the first godet.

The above-mentioned as-spun yarns may be further processed in a conventional manner is subsequent operations to provide staple yarns or filament yarns. Normally, as-spun yarns intended for conversion to staple are produced at a spinning speed of between 300 and 500 pm.

We claim:

1. A process for forming a yarn having at least one electrically conductive filament comprising:

(a) passing a plurality of molten streams downwardly from spinning equipment including a spinneret into a quenching zone, said streams including at least one first stream comprising an electrically conductive material dispersed in a polymeric matrix and at least one second stream consisting essentially of a nonconductive, fiber-forming polymeric component;

(b) solidifying said molten streams in said quenching zone to form a plurality of filaments including at least one conductive filament and a remaining plurality of nonconductive filaments;

(c) converging nonconductive filaments and said conductive filament(s) to form a yarn; and (d) withdrawing said nonconductive filaments and said conductive filament at the same take-up velocity;

wherein said conductive filament(s) are entangled with said nonconductive filaments to the same extent as any of said nonconductive filaments are entangled with said nonconductive filaments.

2. The process of claim wherein said first stream(s) consist essentially of a fiber-forming polymeric first component coextensive with a second component of an electrically conductive material dispersed in a polymeric matrix.

3. The process of claim 1 wherein said nonconductive filaments, after withdrawing, have a denier of from about 6 to about 24.

4. The process of claim 2 wherein said yarn is composed of at least 40 filaments.

5. The process of claim 4 wherein the nonconductive filaments are of a nonround cross-section.

6. The process of claim 5 wherein said conductive material is electrically conductive carbon black.

7. The process of claim 2 wherein from 1 to 5 of the filaments of said antistatic yarn are conductive filaments.

8. The process of claim 2 wherein said velocity is above 1500 meters per minute.

9. The process of claim 8 wherein said velocity is above 2500 meters per minute.

10. The process of claim 9 wherein said velocity is above 3500 meters per minute.

11. The process of claim 7 wherein said yarn is composed of at least 40 filaments.

* * * * *

UNITED STATES PATENT AND TRADEMARK OFFICE

CERTIFICATE OF CORRECTION

PATENT NO. : 5,277,855

DATED : 1/11/94

INVENTOR(S) : Lawrence E. Blackmon, et al.

It is certified that error appears in the above-identified patent and that said Letters Patent is hereby corrected as shown below:

Column 6, line 55, delete "pm" and insert --mpm--.

Column 7, line 16, add --1-- after the word "claim".

Column 8, line 11, delete "antistatic".

Signed and Sealed this

Second Day of August, 1994

Bruce Lehman

*Attest:*

BRUCE LEHMAN

*Attesting Officer*

*Commissioner of Patents and Trademarks*